US010900358B2

(12) United States Patent
Yano et al.

(10) Patent No.: US 10,900,358 B2
(45) Date of Patent: Jan. 26, 2021

(54) PACKAGED COMPRESSOR HOUSING

(71) Applicant: Kobe Steel, Ltd., Hyogo (JP)

(72) Inventors: Yoshio Yano, Kobe (JP); Suguru Kiuchi, Hyogo (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 118 days.

(21) Appl. No.: 16/308,975

(22) PCT Filed: May 25, 2017

(86) PCT No.: PCT/JP2017/019529
§ 371 (c)(1),
(2) Date: Dec. 11, 2018

(87) PCT Pub. No.: WO2017/217209
PCT Pub. Date: Dec. 21, 2017

(65) Prior Publication Data

US 2019/0309626 A1 Oct. 10, 2019

(30) Foreign Application Priority Data

Jun. 16, 2016 (JP) ..... 2016-120034

(51) Int. Cl.
*F01C 21/18* (2006.01)
*F04B 39/00* (2006.01)
(Continued)

(52) U.S. Cl.
CPC ..... *F01C 21/18* (2013.01); *F01C 21/06* (2013.01); *F04B 39/00* (2013.01); *F04B 39/06* (2013.01); *F04C 29/06* (2013.01); *G10K 11/16* (2013.01)

(58) Field of Classification Search
CPC .. F04D 29/664; F04D 29/5826; F04D 25/166; F04D 19/002; F04D 17/16; F04B 41/00; F04B 39/066; F04B 39/0038
(Continued)

(56) References Cited

U.S. PATENT DOCUMENTS 1,865,677 A * 7/1932 Cheyney ..... F24F 13/24 454/370
3,421,687 A * 1/1969 Daily ..... F04D 29/526 415/121.2
(Continued)

FOREIGN PATENT DOCUMENTS

JP 2010-127234 A 6/2010

OTHER PUBLICATIONS

International Search Report issued in PCT/JP2017/019529; dated Aug. 15, 2017.

*Primary Examiner* — J. Todd Newton
(74) *Attorney, Agent, or Firm* — Studebaker & Brackett PC

(57) ABSTRACT

The packaged compressor includes: an exhaust duct having an exhaust port; a gas cooler arranged to be inclined with respect to the exhaust port in the exhaust duct; and at least one sound insulating plate arranged in a direction perpendicular to the exhaust port in the exhaust duct, the sound insulating plate configured to partition the exhaust port. In the packaged compressor, the exhaust port is partitioned into divided openings by the sound insulating plate. Of the divided openings, an area of a first divided opening provided on a side where a distance between the gas cooler and the exhaust port is shortest is larger than an area of a second divided opening.

20 Claims, 14 Drawing Sheets

(51) Int. Cl.

| | |
|---|---|
| ***G10K 11/16*** | (2006.01) |
| ***F04C 29/06*** | (2006.01) |
| ***F01C 21/06*** | (2006.01) |
| ***F04B 39/06*** | (2006.01) |

(58) Field of Classification Search
USPC ..... 415/177
See application file for complete search history.

(56) References Cited

U.S. PATENT DOCUMENTS 4,449,376 A * 5/1984 Draper ..... F25B 39/00 62/259.1
5,140,819 A * 8/1992 Napier ..... F02C 7/045 415/119
5,663,536 A * 9/1997 Kaplan ..... F28C 1/10 181/224
5,916,253 A * 6/1999 Amr ..... B60H 1/00428 62/239
6,273,213 B1 * 8/2001 Callas ..... G10K 11/16 181/200
6,481,527 B1 * 11/2002 French ..... G10K 11/16 181/198
7,314,113 B2 * 1/2008 Doll ..... E04F 17/04 181/225
7,845,463 B2 * 12/2010 Yabe ..... F01N 1/10 181/198
2002/0106282 A1 8/2002 Sharp et al.
2006/0280626 A1 * 12/2006 Nishimura ..... F04C 18/16 417/410.4
2008/0223345 A1 * 9/2008 Hummel ..... F02B 29/0462 123/542
2010/0135840 A1 * 6/2010 Fujimoto ..... F04C 29/04 418/201.1
2012/0292008 A1 * 11/2012 Goldberg ..... F28D 21/0014 165/287
2014/0219781 A1 * 8/2014 Watson ..... F02M 35/12 415/119
2017/0059188 A1 * 3/2017 Hancock ..... F25B 13/00
2019/0309626 A1 * 10/2019 Yano ..... F01C 21/007

* cited by examiner

PACKAGED COMPRESSOR HOUSING

CROSS-REFERENCE TO RELATED APPLICATIONS

This is a national phase application in the United States of International Patent Application No. PCT/JP2017/019529 with an international filing date of May 25, 2017, which claims priority of Japanese Patent Application No. 2016-120034 filed on Jun. 16, 2016 the contents of which are incorporated herein by reference.

TECHNICAL FIELD

The present disclosure relates to a packaged compressor.

BACKGROUND ART

The packaged compressor includes one package in which a compressor main body and a heat exchanger (gas cooler) for cooling the compressed air discharged from the compressor main body are arranged. JP 2010-127234 A discloses a structure in which a gas cooler is disposed in an inclined manner for effective usage of a space in a package. In addition, an intake port of this packaged compressor has a louver structure in which sound insulating plates of the same length are arranged at equal intervals in parallel.

Packaged compressors are often limited in the package size from the viewpoint of the degree of freedom of installation. Therefore, it is required to arrange components in a package such as a gas cooler in a space-saving manner. As with the packaged compressor of JP 2010-127234 A, arranging sound insulating plates of the same length in parallel at equal intervals improves sound insulation performance (silent performance), but there is room for improvement from the viewpoint of space saving.

Embodiments of the present invention are made under such circumstances, and an object of the present invention is to provide a packaged compressor can achieve both of a space saving arrangement of components in a package and silence.

Means for Solving the Problems

The packaged compressor according to an embodiment of the present invention includes: a duct having an opening; a heat exchanger arranged to be inclined with respect to the opening in the duct; and at least one sound insulating plate arranged in a direction perpendicular to the opening in the duct, the sound insulating plate configured to partition the opening. The opening is partitioned into a plurality of divided openings including a first divided opening by the sound insulating plate. The divided opening provided on a side where a distance between the gas cooler and the opening is shortest is larger than areas of the others of the divided openings.

In this case, the "packaged compressor" of the present invention means a compressor in which various components including a compressor main body are arranged in a package. In addition, "perpendicular to the opening" means that the sound insulating plate is arranged in a direction perpendicular to the opening surface in plan view, that is, when the opening is viewed in face-to-face. In addition, "a side where a distance between the gas cooler and the opening is shortest" means, in side view that is as viewed from a direction in which the gas cooler and the sound insulating plate extend, when the length of a distance between the gas cooler and the opening is determined, a side on which the distance is shortest.

According to this configuration, since the heat exchanger is arranged so as to be inclined, the cross-sectional area of the duct can be reduced as compared with the case where the duct is arranged horizontally, the duct can be reduced in size, and the components in the package can be arranged in a space-saving manner. In addition, the noise reduction effect of the duct is generally proportional to the length of the sound insulating plate installed inside the duct and inversely proportional to the size of the opening of the duct. As in the above configuration, when the first divided opening is formed larger, the sound insulating plate is disposed close to the side on which the distance between the heat exchanger and the opening is longer. Therefore, the length of the sound insulating plate that can be installed can be increased, and the noise reduction effect can be improved. In addition, forming the first divided opening large causes the area of the divided opening other than the first divided opening to decrease. In comprehensive consideration of the increase and decrease of the noise reduction effect due to the increase and decrease of the area of the divided openings and the improvement in the noise reduction effect due to the length of the sound insulating plate, when the area of the first divided opening is made largest as compared with the areas of the other divided openings, the amount of noise reduction effect becomes maximum, that is, the silent performance can be maximized.

The inner surface of the duct may be covered with a sound absorbing material.

Since the inner surface of the duct is covered with a sound absorbing material, the noise reduction effect is further improved, and the silent performance can be further improved. Preferably, the entire surface of the inner surface of the duct is covered with a sound absorbing material, and more preferably the sound insulating plate is also covered with a sound absorbing material.

At least two of the sound insulating plates are arranged, and a length of the sound insulating plate may be longer than a length of another of the sound insulating plates arranged adjacent to a side on which a distance between the heat exchanger and the opening is shorter.

Since the length of each of the sound insulating plates is longer than that of the adjacent other sound insulating plates on a side on which a distance between the heat exchanger and the opening is shorter, the length of each of the sound insulating plates is specified to increase toward a side on which a distance between the heat exchanger and the opening is longer. Therefore, the space widened by the inclined arrangement of the heat exchanger can be effectively utilized, and the noise reduction effect can be improved.

The sound insulating plates may be disposed at a predetermined equal space from the heat exchanger.

The larger the length of the sound insulating plate in the duct is, the more the noise reduction effect is improved. However, if the lengths of the sound insulating plates are increased to be too close to the heat exchanger, since the heat exchanger is at a high temperature, the sound insulating plates are thermally affected. In particular, when the sound absorbing material is stuck to the sound insulating plates, the sound absorbing material is thermally deteriorated, and further, the adhesive sticking the sound absorbing material to the sound insulating plates changes in properties due to the high temperature, so that the sound absorbing material is easily peeled off. Therefore, arranging the sound insulating plates with a predetermined equal space, at which the sound insulating plates are not easily thermally affected from the heat exchanger, apart from the heat exchanger, that is, maximally securing the lengths of the sound insulating plates to the extent that the thermal effect is minimal allows the noise reduction effect to be maximally improved while the sound insulating plates are protected from heat deterioration.

The first divided opening may be provided with a blocking portion for partially blocking a region on a side opposite to the sound insulating plate.

Since the first divided opening is the largest of the divided openings, the noise reduction effect tends to be minimized. Furthermore, since the first divided opening is provided on a side on which the distance between the heat exchanger and the opening is the shortest, the maximum value of the length of the sound insulating plate that can be installed is also shorter than that of the other sound insulating plates, and the noise reduction effect tends to be minimized as compared with the other divided openings. Therefore, as in the above configuration, blocking a part of the first divided opening and preventing noise from leaking out allow the noise reduction effect to be improved. In particular, in the first divided opening, since the noise reduction effect is large in the vicinity of the sound insulating plate, it is effective to partially block the region on the side opposite to the sound insulating plate. Furthermore, when the size of the opening is sufficiently secured in consideration of the cooling capacity of the packaged compressor, the present configuration is particularly useful.

Two of the sound insulating plates may be arranged. The divided openings may include the first divided opening, the second divided opening, and the third divided opening positioned in order from a side on which a distance between the heat exchanger and the opening is shorter toward a side on which a distance between the heat exchanger and the opening is longer. The first divided opening may have a width determined by a following mathematical expression (1):

[Mathematical Expression 1]

$$b/3<b1<2b/3 \quad (1)$$

b=b1+b2+b3
b: width of opening
b1: width of first divided opening
b2: width of second divided opening
b3: width of third divided opening Defining the range of the width of the first divided opening as in the above mathematical expression (1) allows the noise reduction effect to be maximized. When the width of the first divided opening is less than the range of the mathematical expression (1), the length of the sound insulating plate forming the first divided opening becomes shorter, and the noise reduction effect decreases. When the width of the first divided opening is larger than the range of the mathematical expression (1), the first divided opening becomes larger, the noise leaking out from the first divided opening becomes larger, and the noise reduction effect decreases. In addition, when the range of the mathematical expression (1) is set as the optimum range of the width of the first divided opening, the noise reduction effect is confirmed to be maximized from the viewpoint of numerical analysis.

Each of the second divided opening and the third divided opening may have a width determined by a following mathematical expression (2):

[Mathematical Expression 2]

$$b2<b/3, b3<b/3 \quad (2)$$

b=b1+b2+b3
b: width of opening
b1: width of first divided opening
b2: width of second divided opening
b3: width of third divided opening According to this configuration, similarly to the above-described first divided opening, the range of each width of the second divided opening and the third divided opening can be set in an optimum range so that the noise reduction effect when two sound insulating plates are used can be maximized. In addition, when the range of the mathematical expression (2) is set as the optimum range of each width of the first to third divided openings, the noise reduction effect is confirmed to be maximized from the viewpoint of numerical analysis.

One of the sound insulating plates may be arranged. Of the first divided opening and the second divided opening arranged in order from a side on which a distance between the gas cooler and the opening is shorter toward a side on which a distance between the gas cooler and the opening is longer, a width of the first divided opening may be determined by a following mathematical expression (3):

[Mathematical Expression 3]

$$0.6 \le b1/b \le 0.8 \quad (3)$$

b=b1+b2
b1: width of first divided opening
b2: width of second divided opening

According to this configuration, similarly to the case of the above-described two sound insulating plates, even in the case of one sound insulating plate, the range of the width of the first divided opening can be set to the optimum range as shown in mathematical expression (3) so that the noise reduction effect when one sound insulating plate is used can be maximized. In addition, when the range of the mathematical expression (3) is set as the optimum range of the width of the first divided opening, the noise reduction effect is confirmed to be maximized from the viewpoint of numerical analysis.

The first divided opening may have a width determined by a following mathematical expression (4):

[Mathematical Expression 4]

$$-0.0013\theta+0.67 \le b1/b \le -0.0041\theta+0.94 \quad (4)$$

b=b1+b2
b: width of opening
b1: width of first divided opening
b2: width of second divided opening
θ: inclination angle with respect to opening of gas cooler According to this configuration, in consideration of a case where the inclination angle θ changes, the noise reduction effect can be maximized when one sound insulating plate is used. In addition, when the range of the mathematical expression (4) is set as the optimum range of the width of the first divided opening, the noise reduction effect is confirmed to be maximized from the viewpoint of numerical analysis.

A surface of the sound insulating plate facing the heat exchanger may be covered with a sound absorbing material. A tip portion of the sound absorbing material of the sound insulating plate facing the heat exchanger may be chamfered.

Thus, the sound absorbing material can be separated from the heat exchanger by the amount by which a corner of the sound absorbing material of the sound insulating plate is removed, and the sound insulating plate can be lengthened by that amount.

The tip portion of the sound insulating plate may be bent toward the heat exchanger.

Since the tip portions of the sound insulating plates are bent, it is difficult for the sound waves traveling between the sound insulating plates to travel straight, that is, noise hardly leaks directly to the outside. Therefore, the noise reduction effect can be improved and the silent performance can be improved.

The tip portion of the sound insulating plate may have a shape defined by a following mathematical expression (5):

[Mathematical Expression 5]

$$m \times \sin \zeta > bx \quad (5)$$

m: length of tip portion of sound insulating plate
ζ: bending angle of tip portion of sound insulating plate
bx: width of divided opening partitioned by sound insulating plate According to this configuration, when the inside of the duct is viewed from the opening, since the heat exchanger is positioned behind the bent tip portions of the sound insulating plates, that is, the heat exchanger cannot be directly viewed, it is possible to prevent noise from the heat exchanger from directly leaking out to the outside and to improve the noise reduction effect.

The sound insulating plate may include a protruding portion on a surface facing the heat exchanger.

According to this configuration, similarly to the above, it is possible to prevent noise from directly leaking to the outside and to improve the noise reduction effect. In addition, since only the protruding portions are provided, the flow passage area between the sound insulating plates is not reduced.

The duct may be an exhaust duct.

Since the exhaust duct guides the air flowing out of the package, providing the sound insulating structure as described above to the exhaust duct can effectively prevent leakage of noise to the outside of the package.

According to the present invention, arranging the heat exchanger to be inclined and defining the size of the first divided opening allow a packaged compressor in which space-saving arrangement of components in the package and silence are compatible with each other to be provided.

MODE FOR CARRYING OUT THE INVENTION

In the following, embodiments of the present invention will be described with reference to the accompanying drawings.

First Embodiment (Configuration of Packaged Compressor)

Figure 1:
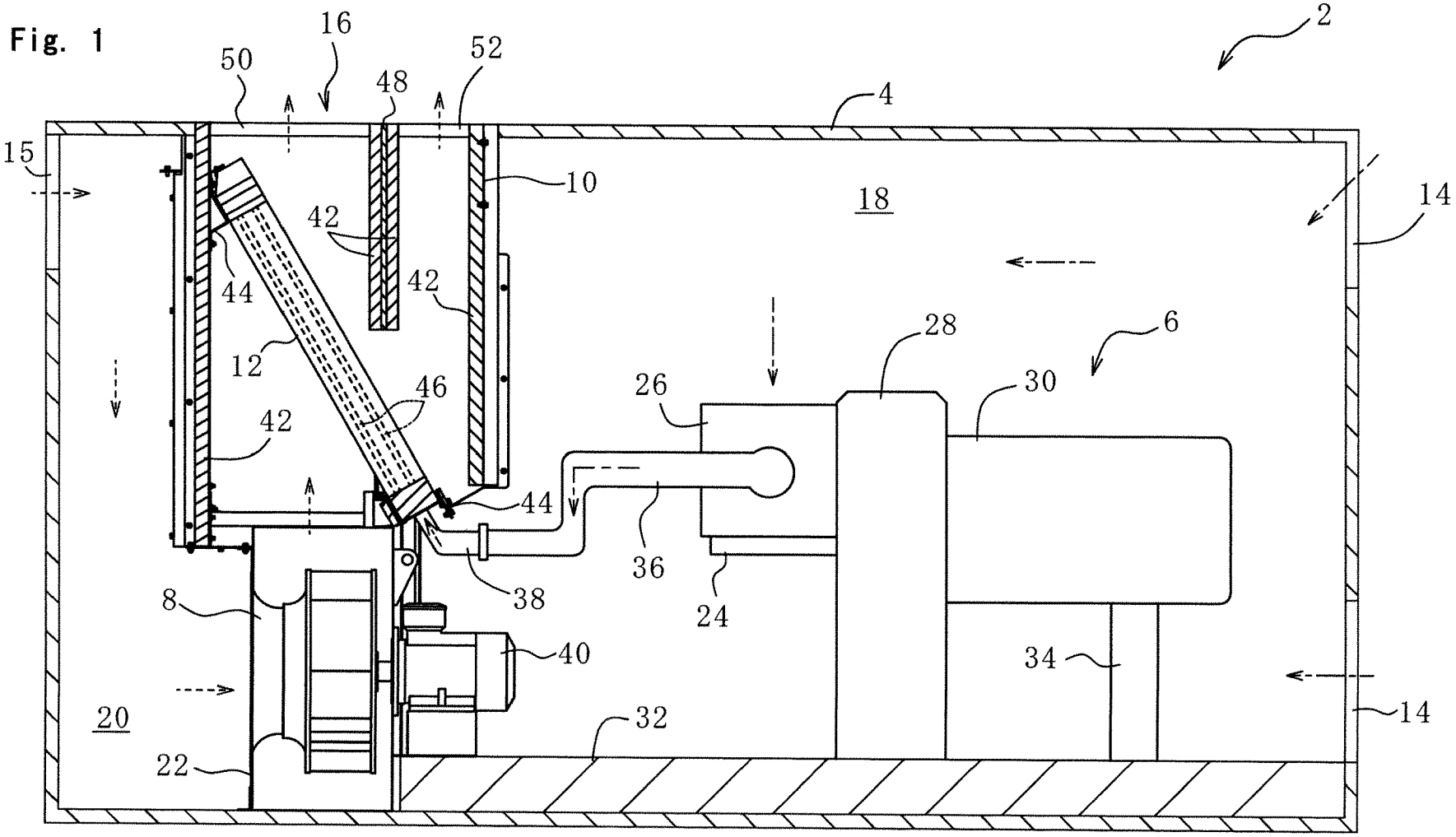
FIG. 1 is a side sectional view of a packaged compressor according to a first embodiment of the present invention.

Referring to FIG. 1, a packaged compressor 2 of the present embodiment includes a box-type package 4. The inside of the package 4 is provided with a compressor main body 6, a turbofan 8 functioning as a cooling fan, an exhaust duct (duct) 10, and a gas cooler (heat exchanger) 12.

The package 4 is formed of a metal plate such as a steel plate and includes intake ports 14 and 15 and an exhaust port (opening) 16. A filter (not shown) is attached to the intake ports 14 and 15, and air from which foreign matters such as dust are removed by the filter is introduced into the package 4. The space in the package 4 is divided into a compression chamber 18 and an air cooling chamber 20. The compression chamber 18 and the air cooling chamber 20 are partitioned by the exhaust duct 10 and the fan cover 22 of the turbofan 8 so that air does not directly come in and out from each other.

First, the configuration in the compression chamber 18 will be described.

In the compression chamber 18, the compressor main body 6 is disposed. The compressor main body 6 of the present embodiment is of a two-stage screw type. The compressor main body 6 includes a first-stage compressor main body 24, a second-stage compressor main body 26, a gear box 28, and a compressor motor 30.

The gear box 28 is fixed to a base 32 constituting the floor of the compression chamber 18. The compressor motor 30 is fixed to the base 32 by a supporting column 34. Each of the first-stage compressor main body 24 and the second-stage compressor main body 26 includes an intake port, a discharge port, and a pair of male and female screw rotors inside. The first-stage compressor main body 24 and the second-stage compressor main body 26 suck air from the intake ports. Each of the screw rotors is mechanically connected to the compressor motor 30 via the gear box 28, and is rotationally driven by the compressor motor 30, and the sucked air is compressed. The intake port of the first-stage compressor main body 24 is opened in the package 4. The discharge port of the first-stage compressor main body 24 is fluidly connected to the intake port of the second-stage compressor main body 26 through a pipe (not shown). The discharge port of the second-stage compressor main body 26 is fluidly connected to the inlet port 38 of the gas cooler 12 through a pipe 36.

Next, the configuration in the air cooling chamber 20 will be described.

In the air cooling chamber 20, a turbofan 8 and an exhaust duct 10 are arranged.

A fan cover 22 is attached to the turbofan 8 and is disposed in a lower part of the air cooling chamber 20. In addition, the turbofan 8 includes a fan motor 40. The fan motor 40 is disposed on the base 32. The turbofan 8 is driven by the fan motor 40 and causes the air in the air cooling chamber 20 to flow from the intake port 15 to the exhaust port 16. Although the configuration in the air cooling chamber 20 is described here, the fan motor 40 is disposed inside the compression chamber 18.

The exhaust duct 10 guides the air delivered by the turbofan 8 to the exhaust port 16. The lower end of the exhaust duct 10 is connected to the fan cover 22 of the turbofan 8, and the upper end thereof is connected to the upper surface and the exhaust port 16 of the package 4. A sound absorbing material 42 is stuck to the inner surface of the exhaust duct 10. The sound absorbing material 42 is a spongy soft member. The sound absorbing material 42 absorbs noise energy and attenuates noise.

Inside the exhaust duct 10, the gas cooler 12 is disposed inclined with respect to the exhaust port 16. In the present embodiment, the inclination angle θ of the gas cooler 12 is 45 degrees (see FIG. 2). The inclination angle θ is preferably set in the range of 30 degrees to 65 degrees from the viewpoint of the cooling capacity, the space-saving arrangement of the gas cooler 12, and the like. In order that this inclination angle θ is maintained, the gas cooler 12 is bolted to the exhaust duct 10 by a stopper 44.

The gas cooler 12 includes an inlet port 38, a plurality of tubes 46 communicating with the inlet port 38, and an outlet port (not shown) communicating with the plurality of tubes 46. The air compressed by the compressor main body 6 is introduced into the gas cooler 12 from the inlet port 38 and is led out from an outlet port (not shown) through the tube 46. The air delivered by the turbofan 8 passes between the tubes 46 of the gas cooler 12 from the bottom to the top in the drawing. Therefore, in the gas cooler 12, heat exchange is performed between the air inside and outside the tube 46. Specifically, the air inside the tube 46 compressed by the compressor main body 6 is cooled, and the air outside the tube 46 delivered by the turbofan 8 is heated.

In the exhaust duct 10, a sound insulating plate 48 is disposed. The sound insulating plate 48 of the present embodiment is a quadrangular steel plate. The sound insulating plate 48 is disposed to be fixed perpendicularly to the exhaust port 16 so as to partition the exhaust port 16. The term "perpendicularly to the exhaust port 16" specifically means that the sound insulating plate 48 is arranged in the direction perpendicular to the opening surface (vertical direction) as the exhaust port 16 is viewed in face-to-face in a plan view (see an arrow N in FIG. 3). In addition, sound absorbing materials 42 are stuck to both surfaces of the sound insulating plate 48 similarly to the inner surface of the exhaust duct 10. That is, the sound insulating plate 48 is sandwiched between two sound absorbing materials 42.

The exhaust port 16 is partitioned by the sound insulating plate 48 and divided into a first divided opening 50 and a second divided opening 52. The first divided opening 50 is provided on the side on which the distance between the gas cooler 12 and the exhaust port 16 is shorter (on the left side in the drawing). The second divided opening 52 is provided on the side on which the distance between the gas cooler 12 and the exhaust port 16 is longer (on the right side in the drawing). Here, the side on which the distance between the gas cooler 12 and the exhaust port 16 is shorter or longer is determined from the side view shown in FIG. 2, that is, as seen from the direction in which the sound insulating plate 48 and the gas cooler 12 extend. This also applies to the following embodiments.

Figure 2:
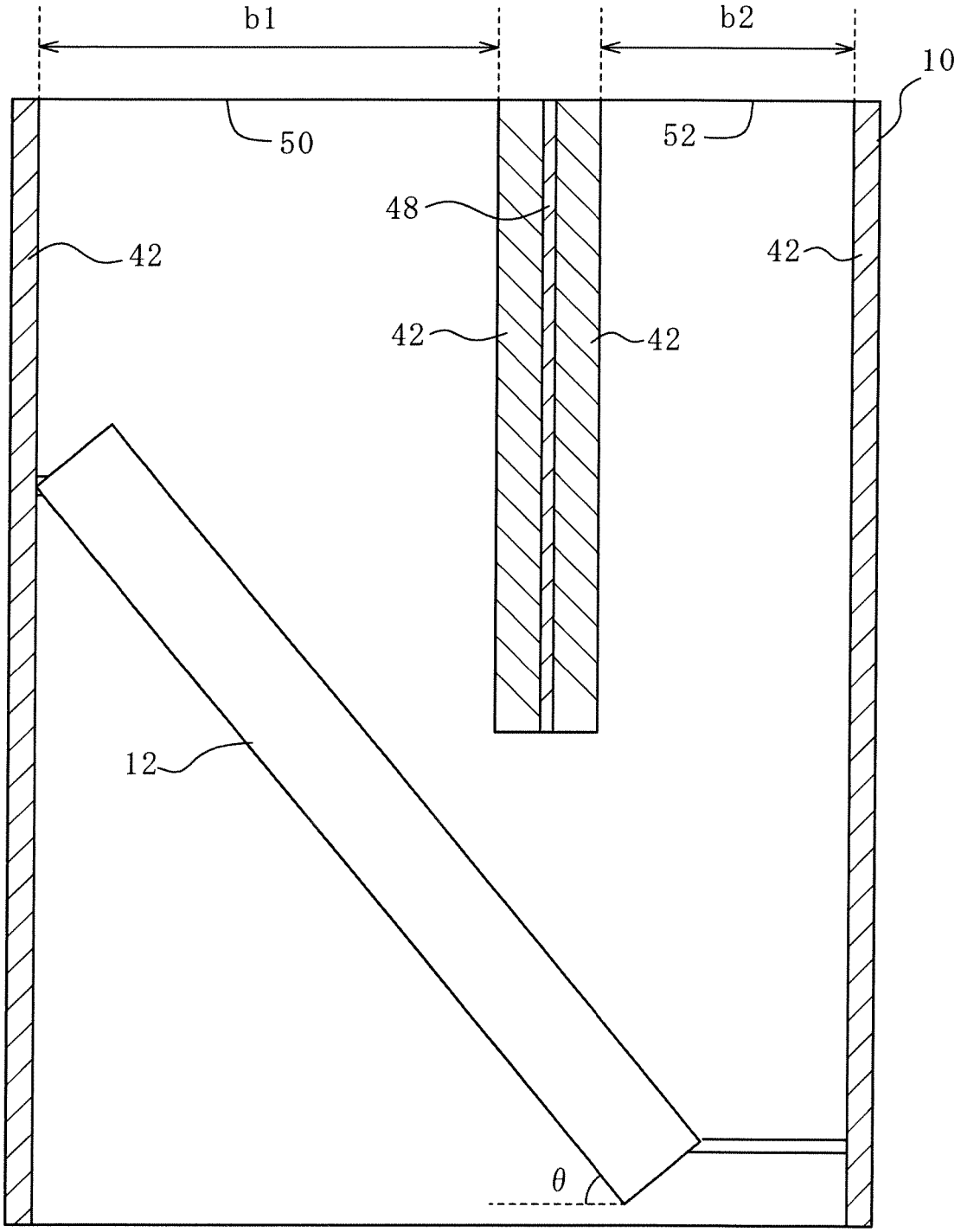
FIG. 2 is an enlarged view of a duct portion in FIG. 1.

As shown in FIG. 2, the area of the first divided opening 50 is formed larger than the area of the second divided opening 52. The areas of the first and second divided openings 50 and 52 herein indicate the opening areas when the first and second divided openings 50 and 52 are viewed in face-to-face in a plan view (see the arrow N in FIG. 3). Specifically, as shown in the following mathematical expression (6), the sound insulating plate 48 is arranged so that the width b1 of the first divided opening 50 is within the range of 0.6 to 0.8 with respect to the total b of the width b1 of the first divided opening 50 and the width b2 of the second divided opening 52. In addition, the width b1 or b2 herein denotes the distance between the sound insulating plate 48 (or the sound absorbing material 42 stuck to the sound insulating plate 48) and the inner surface of the exhaust duct 10 (or the sound absorbing material 42 stuck to the inner surface of the exhaust duct 10).

[Mathematical Expression 6]

$$0.6 \leq b1/b \leq 0.8 \quad (6)$$

b=b1+b2 b: width of opening b1: width of first divided opening b2: width of second divided opening In addition, the sound insulating plate 48 is disposed with a predetermined space d apart from the gas cooler 12. The predetermined space d is set so that the sound insulating plate 48 is hardly affected by heat from the gas cooler 12. Details of the space d will be described below.

(Action of Packaged Compressor)

With reference to FIG. 1, first, the flow of air in the compression chamber 18 will be described (see the alternate long and short dash line arrow in the drawing).

The normal-temperature air outside the package 4 flows into the package 4 through the intake port 14. The inflowing air is sucked into the first-stage compressor main body 24 to be compressed, and then is pressurized and fed to the second-stage compressor main body 26, and further compressed. Here, due to the compression heat generated during compression, the temperature of compressed air becomes high. The high-temperature and high-pressure air compressed by the compressor main body 6 is pressurized and fed through the pipe 36 to the inlet port 38 of the gas cooler 12. The high-temperature and high-pressure air introduced into the gas cooler 12 from the inlet port 38 of the gas cooler 12 is cooled by the air outside the tube 46 while passing through the tube 46 of the gas cooler 12, that is, is heat-exchanged to be supplied from an outlet port (not shown) to a supply destination outside the package 4.

Next, the flow of air in the air cooling chamber 20 will be described (see the broken line arrow in the drawing).

The normal-temperature air outside the package 4 flows into the package 4 through the intake port 15. The inflowing air is sucked into the turbofan 8 and delivered upward in the drawing, that is, with noise into the exhaust duct 10. The air delivered into the exhaust duct 10 is heat-exchanged with the compressed air in the tube 46 while passing between the tubes 46 of the gas cooler 12 as described above to be heated. After the noise energy is absorbed by the sound insulating plate 48 to which the sound absorbing material 42 is stuck and the inner surface of the exhaust duct 10 to which the sound absorbing material 42 is stuck, the air passing through the gas cooler 12 is exhausted from the exhaust port 16 to the outside of the package 4.

(Effects of Packaged Compressor)

According to the configuration of the present embodiment, covering the inner surface of the exhaust duct 10 with the sound absorbing material 42 improves the noise reduction effect as compared with the case where nothing is done and improves the silent performance. As in the present embodiment, it is preferable that the sound absorbing material 42 is covered on the entire inner surface of the exhaust duct 10, and the sound insulating plate 48 is also covered with the sound absorbing material 42, but the present invention is not limited to this, and the sound absorbing material 42 may be stuck to a part of the inside of the exhaust duct 10.

In addition, since the gas cooler 12 is disposed to be inclined, the cross-sectional area of the exhaust duct 10 can be reduced as compared with the case where the gas cooler 12 is disposed horizontally, that is, the exhaust duct 10 can be reduced in size, and the components in the package 4 can be arranged in a space-saving manner. In addition, the noise reduction effect of the exhaust duct 10 is generally not only proportional to the length of the sound insulating plate 48 installed inside the exhaust duct 10 but also inversely proportional to the size of the exhaust port 16. As described above, when the first divided opening 50 is formed larger, the sound insulating plate 48 is disposed close to the side on which the distance between the gas cooler 12 and the exhaust port 16 is longer. Therefore, the length of the sound insulating plate 48 that can be installed can be increased, and the noise reduction effect can be improved. In addition, forming the first divided opening 50 large causes the area of the second divided opening 52 to decrease. In comprehensive consideration of the increase and decrease of the noise reduction effect due to the increase and decrease of the area of the divided openings 50 and 52 and the improvement in the noise reduction effect due to the length of the sound insulating plate 48, when the area of the first divided opening 50 is made largest as compared with the areas of the other divided openings 52, the amount of noise reduction effect becomes maximum, that is, the silent performance can be maximized.

Figure 3:
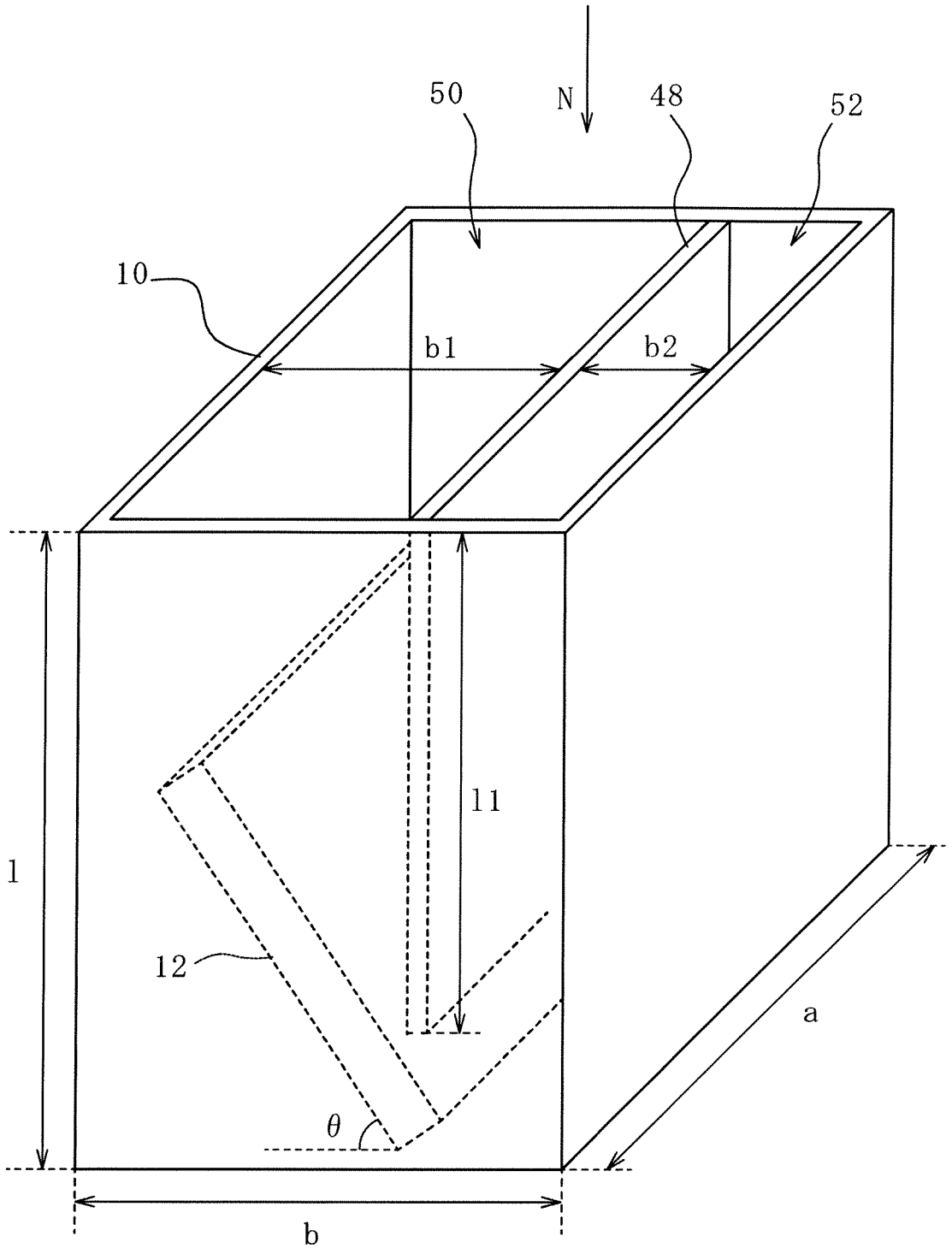
FIG. 3 is a perspective view of the duct portion in FIG. 1.

In order for maximization of the amount of noise reduction effect to be quantitatively examined, numerical analysis is performed as shown in FIGS. 3 to 6. As shown in FIG. 3, the analysis model is a rectangular parallelepiped exhaust duct 10 having dimensions of height l, width b, and depth a (where a=2b). The gas cooler 12 is disposed to be inclined at an inclination angle θ with respect to the exhaust port 16. For the width b1 of the first divided opening 50 and the width b2 of the second divided opening 52, let K be the sound absorption constant, then the noise reduction amounts TL1 and TL2 of the respective divided openings 50 and 52 are represented by the following mathematical expression (7): where l1 is the length of the sound insulating plate 48. It should be noted that in the analysis model, the thickness of the wall of the exhaust duct 10, the thickness of the sound insulating plate 48, and the thickness of the sound absorbing material 42 stuck thereto are sufficiently smaller than the widths b1 and b2 of the respective divided openings 50 and 52, that is, calculation is made assuming that b=b1+b2 is satisfied.

[Mathematical Expression 7]

$$TL1=K\times2(a+b1)/a/b1\times l1+K\times2(a+b)/a/b\times(l-l1)$$

$$TL2=K\times2(a+b2)/a/b2\times l1+K\times2(a+b)/a/b\times(l-l1) \quad (7)$$

Maximizing TL1 and TL2 in mathematical expression (7) allows the amount of noise reduction effect to be maximized. However, since the size of the exhaust duct 10 is defined, b1+b2 takes a constant value b. In addition, the length l1 of the sound insulating plate 48 is required to be a length such that the sound insulating plate 48 does not interfere with the gas cooler 12. That is, the length l1 of the sound insulating plate 48 depends on the inclination angle θ of the gas cooler 12 and the width b1 of the first divided opening.

Figure 4:
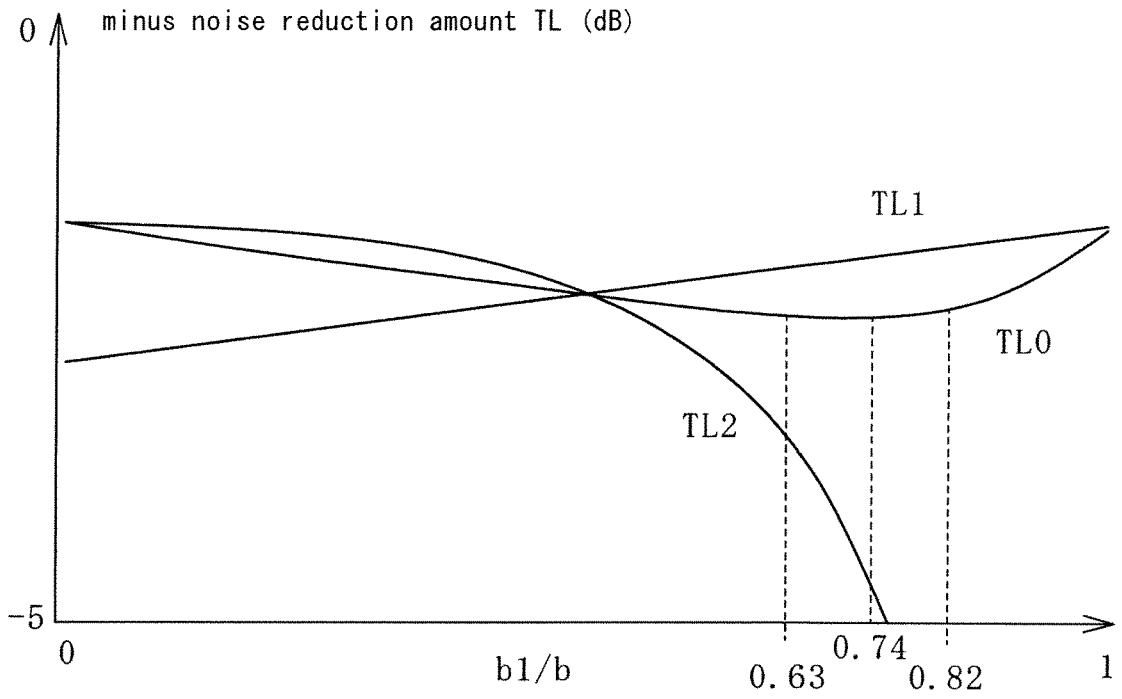
FIG. 4 is a graph showing noise reduction effect in a case where θ=30°.

Under the above conditions, FIG. 4 shows the result of analysis of the noise reduction amount TL for the analysis model in FIG. 3 at θ=30°. The horizontal axis shows the ratio (b1/b) of the width b1 of the first divided opening to the width b (=b1+b2) of the exhaust duct 10. The vertical axis shows the minus noise reduction amount TL (dB). In FIG. 4, graphs of noise reduction amounts TL1 and TL2, and their average value TL0 are shown. In the case where evaluating the silent performance from the graph, when the average value TL0 of the noise reduction amount is the largest, it can be evaluated that the best silent performance is exhibited. Therefore, in the graph in FIG. 4, when b1/b=0.74, the best silent performance is exhibited. In addition, in consideration of the range of error 0.05 (db) from the optimum value, b1/b is preferably in the range of 0.63≤b1/b≤0.82.

Figure 5:
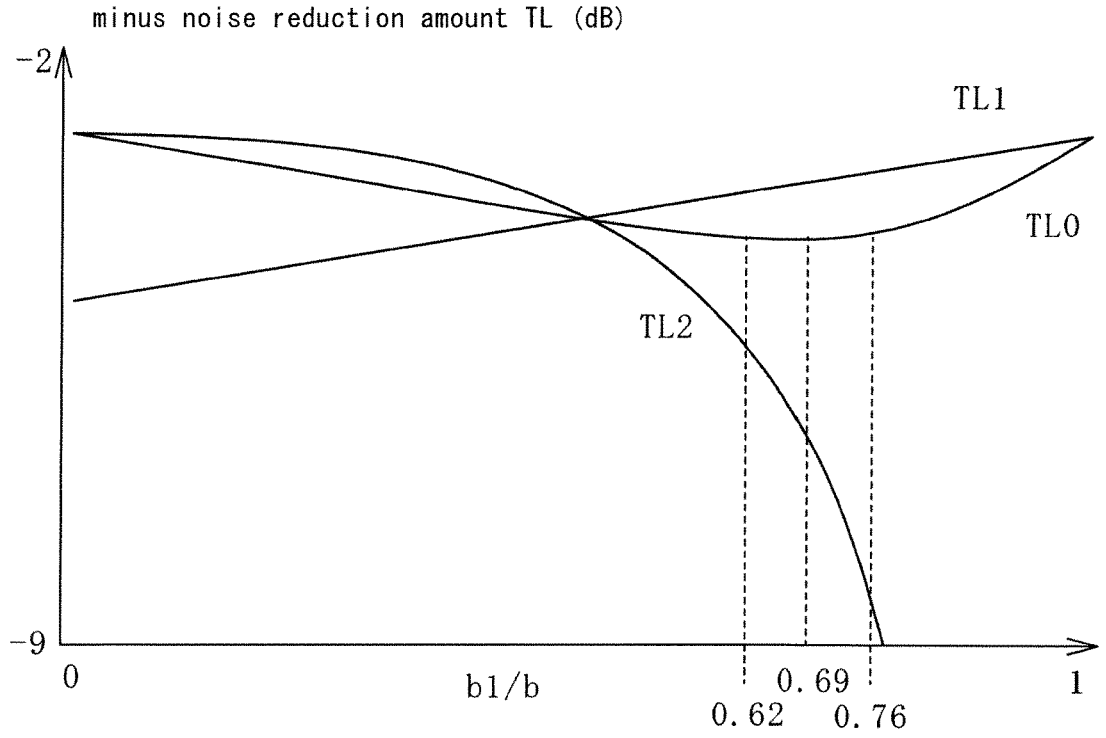
FIG. 5 is a graph showing noise reduction effect in a case where θ=45°.
Figure 6:
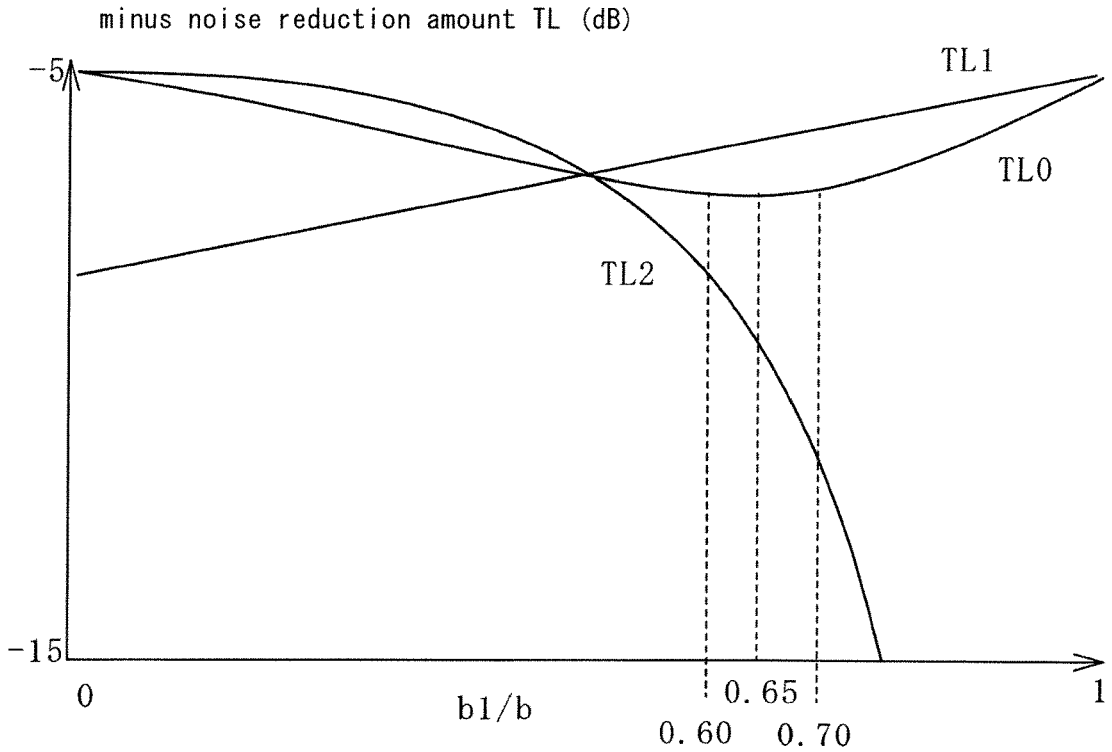
FIG. 6 is a graph showing noise reduction effect in a case where θ=60°.

FIGS. 5 and 6 show the analysis results of the noise reduction amount TL as in FIG. 4 in the case of θ=45° and 60°. As shown in FIG. 5, in the case where θ=45°, when b1/b=0.69, the best silent performance is exhibited. In consideration of the range of error 0.05 (db) from the optimum value, b1/b is preferably in the range of 0.62≤b1/b≤0.76. As shown in FIG. 6, in the case where θ=60°, when b1/b=0.65, the best silent performance is exhibited. In consideration of the range of error 0.05 (db) from the optimum value, b1/b is preferably in the range of 0.60≤b1/b≤0.70. The inclination angle θ of the gas cooler 12 is often used in the range of 30° 5 0 5 65° as described above. Therefore, in the range of the inclination angle θ, the width b1 of the first divided opening 50 is preferably set to be approximately within the range of 0.6≤b1/b≤0.8 in order that the range of error 0.05 (db) from the above-described optimum value in FIG. 4 (θ=30°) to FIG. 6 (θ=60°) is included. Furthermore, the width b1 of the first divided opening 50 is more preferably set to be within the range of 0.63≤b1/b≤0.70.

Figure 7:
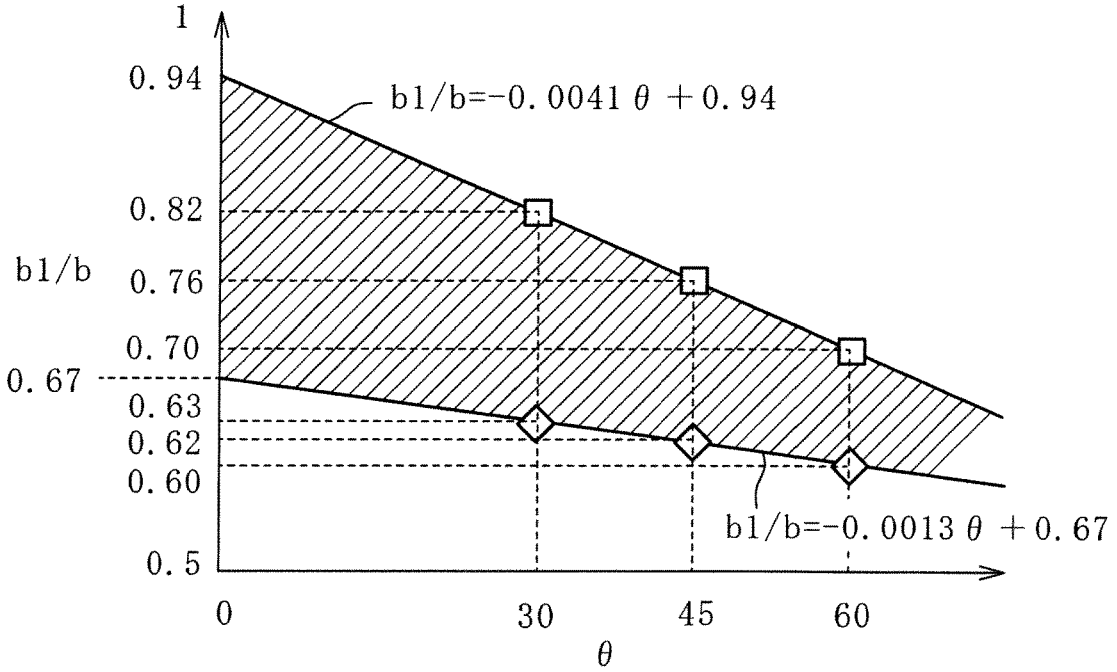
FIG. 7 is a graph depicting an optimum range including an error 0.05 (db) in FIGS. 4 to 6.

Furthermore, FIG. 7 plots the optimum range including the error 0.05 (db) of the ratio (b1/b) of the width b1 of the first divided opening 50 with respect to the inclination angle θ of the gas cooler 12 based on the results in FIGS. 4 to 6. It is preferable to design the packaged compressor 2 in the range satisfying the following mathematical expression (8) as in the range indicated by the hatched portion within the range of the two straight lines in FIG. 7. Designing in this manner allows the noise reduction effect with one sound insulating plate 48 to be maximized in consideration of even the inclination angle θ changing.

[Mathematical Expression 8]

$$-0.0013\theta+0.67\leq b1/b\leq-0.0041\theta+0.94 \quad (8)$$

b=b1+b2 b: width of opening b1: width of first divided opening b2: width of second divided opening θ: inclination angle with respect to opening of heat exchanger In the present embodiment, a noise prevention structure as described above is provided in the exhaust duct 10, and since the exhaust duct 10 guides the air flowing out of the package 4, providing the exhaust duct 10 with the sound insulating structure as described above is effective for preventing noise from leaking outside the package 4. However, when there is an intake duct, a similar noise prevention structure may be provided in the intake duct. This also applies to the second embodiment and subsequent modifications.

Second Embodiment

Figure 8:
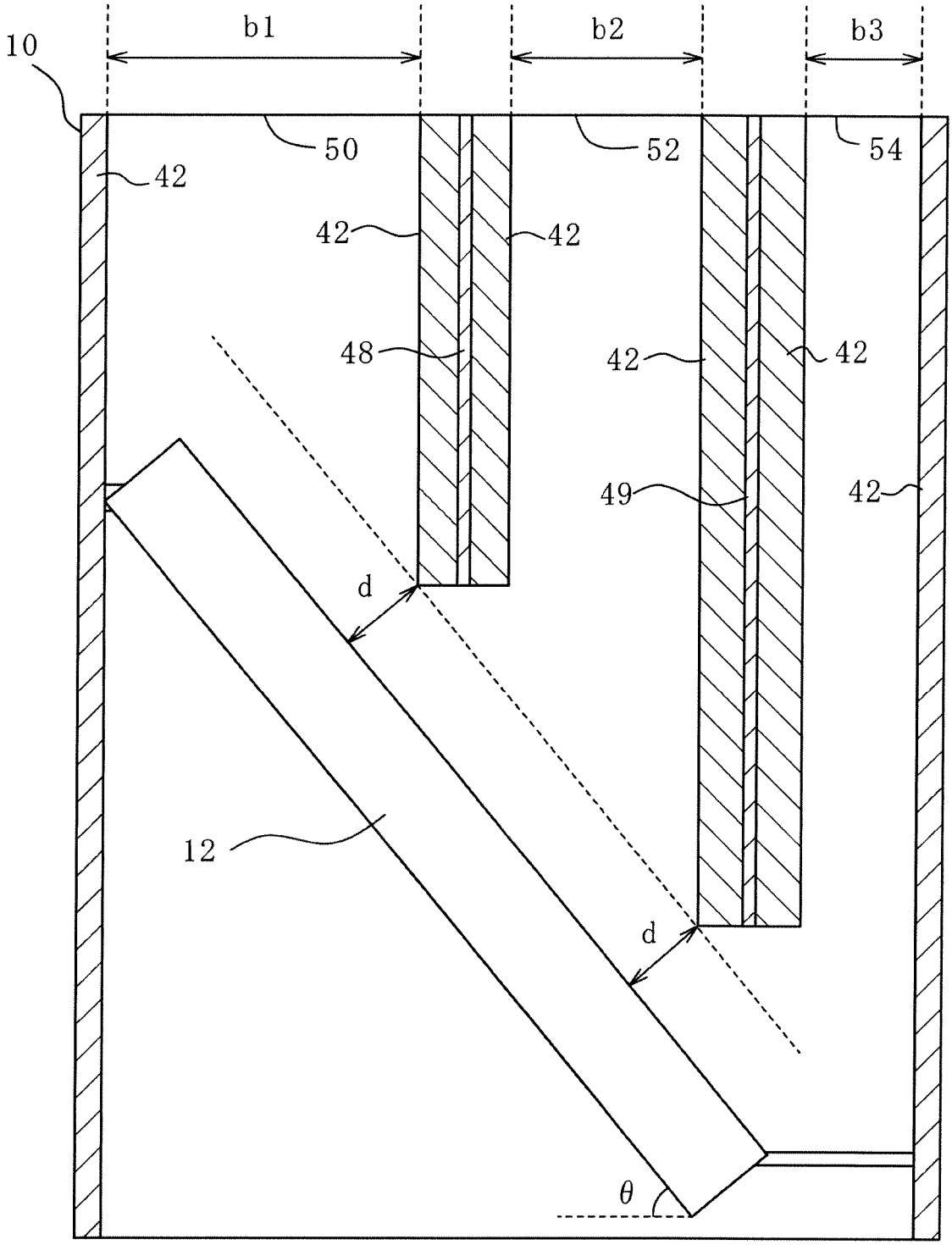
FIG. 8 is an enlarged view of a duct portion of a packaged compressor according to a second embodiment of the present invention.

In the exhaust duct 10 of the packaged compressor 2 of the present embodiment shown in FIG. 8, two sound insulating plates 48 and 49 are arranged. The packaged compressor 2 of the present embodiment has the same configuration as that of the packaged compressor 2 of the first embodiment in FIGS. 1 and 2, except for this configuration. Therefore, the same reference numerals are given to the same parts as those shown in FIGS. 1 and 2, and description thereof will be omitted.

In the packaged compressor 2 of the present embodiment, two sound insulating plates 48 and 49 are arranged perpendicularly to the exhaust port 16, that is, arranged vertically. Therefore, the exhaust port 16 is partitioned by the two sound insulating plates 48 and 49, and divided into a first divided opening 50, a second divided opening 52, and a third divided opening 54 in order from the side on which the distance between the gas cooler 12 and the exhaust port 16 is shorter (the left side in the drawing) to the side on which the distance is longer (the right side in the drawing).

In the present embodiment, the sound insulating plates 48 and 49 are arranged so that the width b1 of the first divided opening 50 is larger than the widths b2 and b3 of the other divided openings 52 and 54. Furthermore, the sound insulating plates 48 and 49 are arranged so that the widths b1, b2, and b3 of the first, second, and third divided openings 50, 52, and 54 are within predetermined ranges satisfying the following mathematical expression (9): In addition, the widths b1, b2 herein respectively denote the distances between the sound insulating plate 48 (or the sound absorbing material 42 stuck to the sound insulating plate 48), the sound insulating plate 49 (or the sound absorbing material 42 stuck to the sound insulating plate 49), and the inner surface of the exhaust duct 10 (or the sound absorbing material 42 stuck to the inner surface of the exhaust duct 10).

[Mathematical Expression 9]

$$b/3<b1<2b/3, b2<b/3, b3<b/3 \quad (9)$$

b=b1+b2+b3 b: width of opening b1: width of first divided opening b2: width of second divided opening b3: width of third divided opening In addition, of the sound insulating plates 48 and 49, the sound insulating plate 49 disposed on the side on which the distance between the gas cooler 12 and the exhaust port 16 is longer is longer. Specifically, the lengths l1 and l2 of the sound insulating plates 48 and 49 are respectively provided with the same predetermined distances d apart from the gas cooler 12. As the lengths of the sound insulating plates 48 and 49 are longer, the noise reduction effect is generally improved. However, if the lengths of the sound insulating plates 48 and 49 are increased to be too close to the gas cooler 12, since the gas cooler 12 is at a high temperature, the sound insulating plates 48 and 49 are thermally affected. In particular, when the sound absorbing material 42 is stuck to the sound insulating plates 48 and 49 as in the present embodiment, the sound absorbing material 42 is thermally deteriorated, and further, the adhesive sticking the sound absorbing material 42 to the sound insulating plates 48 and 49 changes in properties due to the high temperature, so that the sound absorbing material 42 is easily peeled off. Therefore, arranging the sound insulating plates 48 and 49 with a predetermined space d (see FIG. 8), at which the sound insulating plates 48 and 49 are not easily thermally affected from the gas cooler 12, apart from the gas cooler 12, that is, maximally securing the lengths of the sound insulating plates 48 and 49 to the extent that the thermal effect is minimal allows the noise reduction effect to be maximally improved while the sound insulating plates 48 and 49 are protected from heat deterioration.

Figure 9:
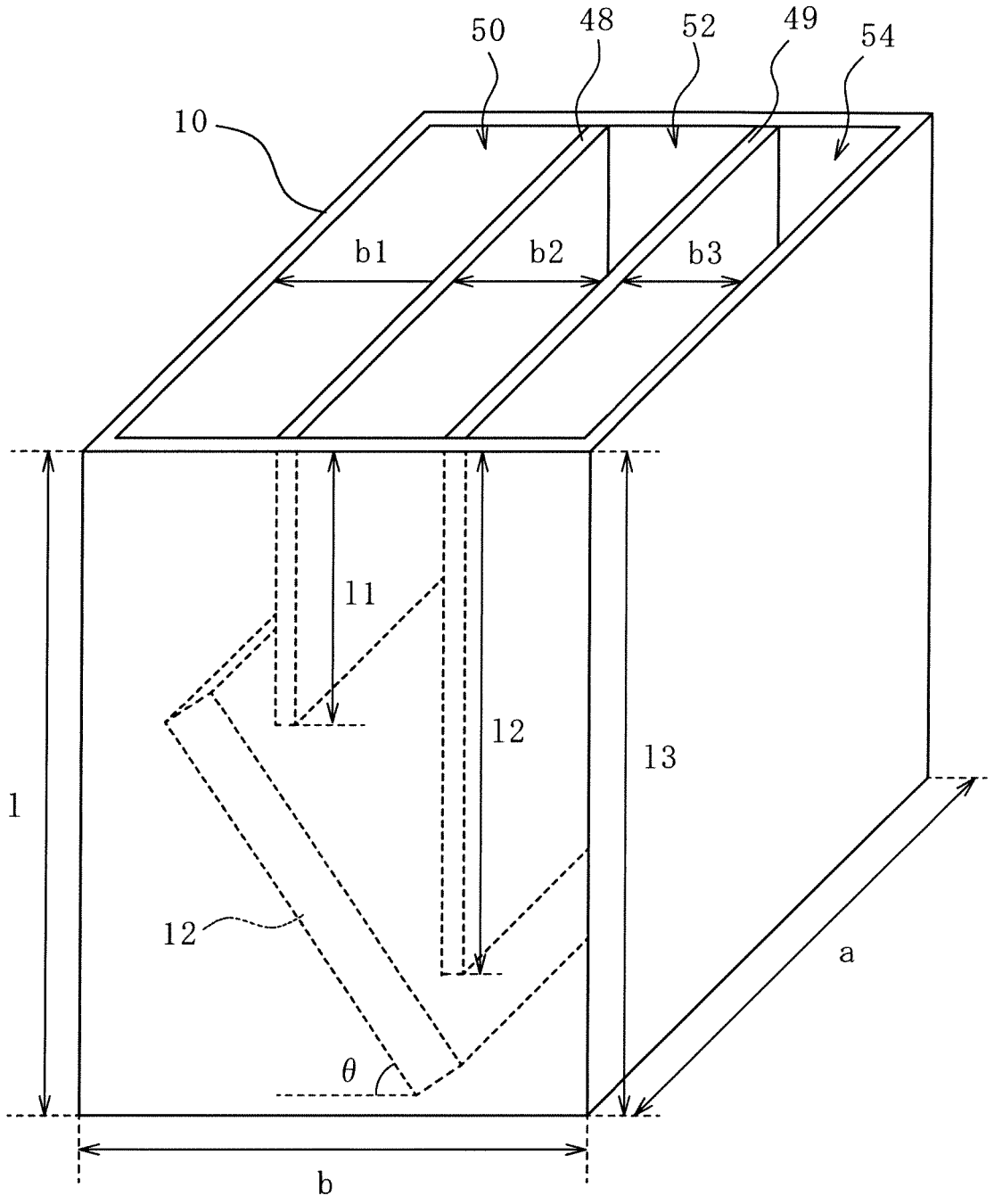
FIG. 9 is a perspective view of the duct portion in FIG. 8.

In addition, as shown in FIGS. 8 and 9 and the following mathematical expression (10), the length l of the sound insulating plate 49 can also be expressed based on the length l1 of the adjacent sound insulating plate 48, the width b2 of the second divided opening 52, and the thickness t of the sound absorbing material 42. This also applies to the case where three or more sound insulating plates are provided, that is, the length of the sound insulating plate can be expressed based on the length of the adjacent sound insulating plate and the like. Therefore, specifying the length of one sound insulating plate allows the length of the remaining sound insulating plate to be specified.

[Mathematical Expression 10]

$$l2=l1+(b2+2t)\times\tan\theta \quad (10)$$

Thus, increasing the length of the sound insulating plate 49 on the side on which the distance between the gas cooler 12 and the exhaust port 16 is longer, and more specifically, maximally increasing the length of the two sound insulating plates 48 and 49 allows the space widened due to the inclined arrangement of the gas cooler 12 to be effectively utilized, and the noise reduction effect to be improved.

Figure 10:
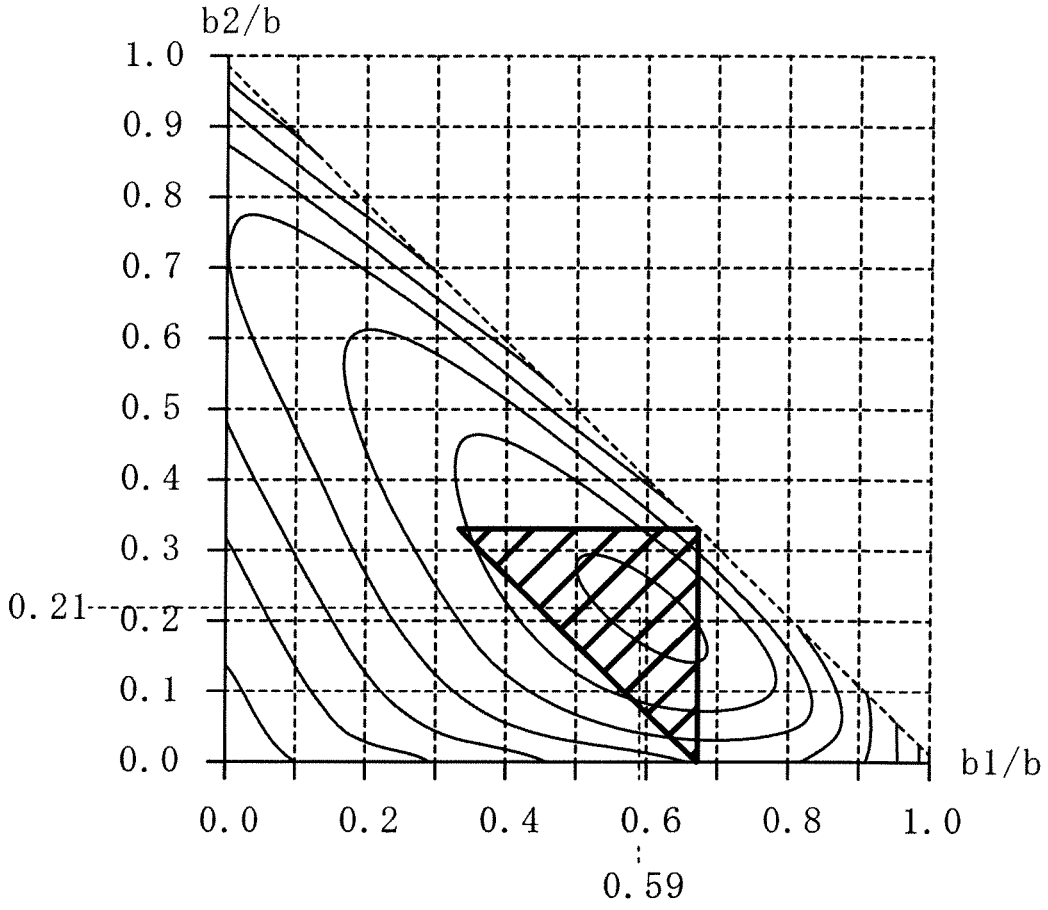
FIG. 10 is a graph showing noise reduction effect in a case where θ=30°.
Figure 11:
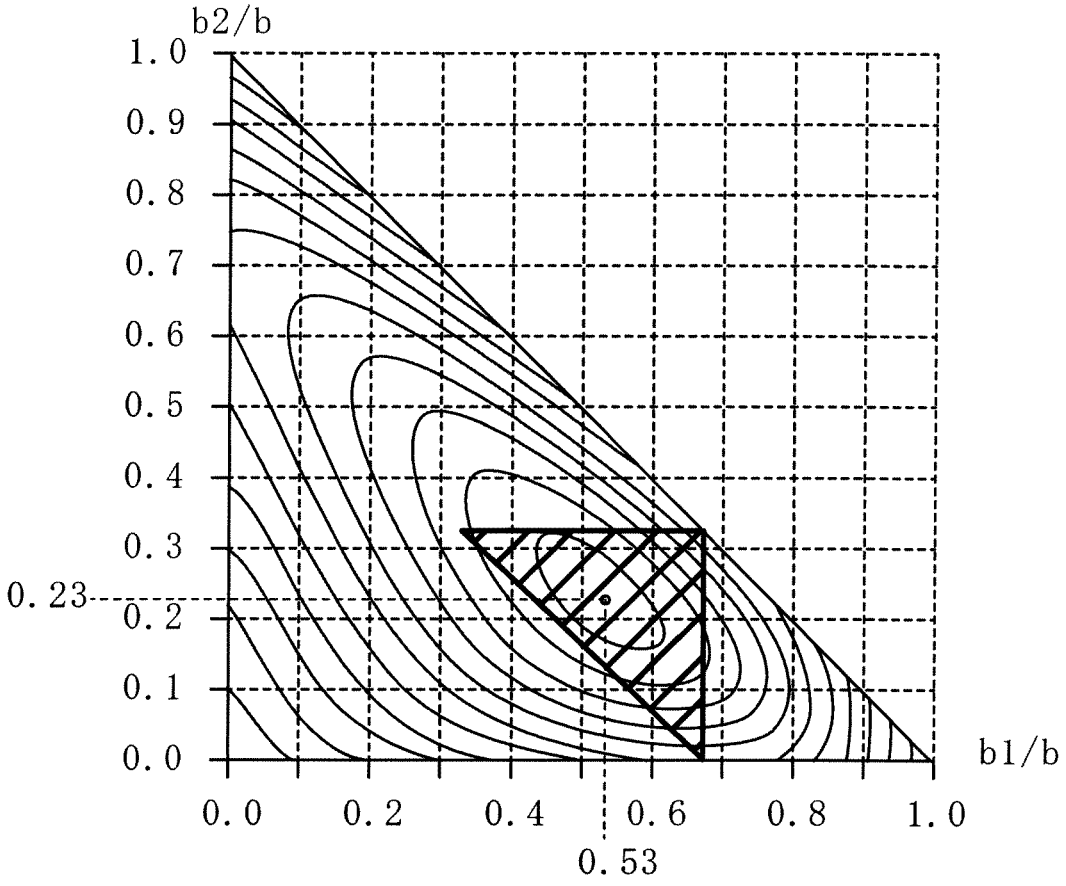
FIG. 11 is a graph showing noise reduction effect in a case where θ=45°.
Figure 12:
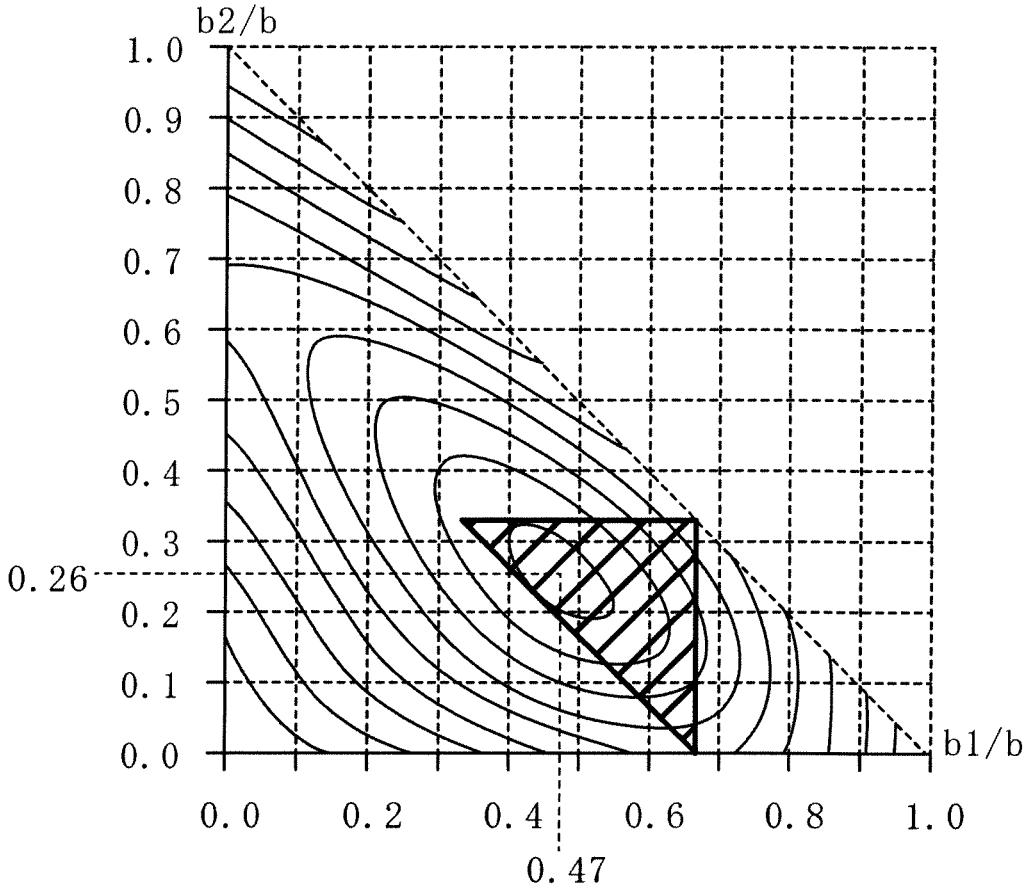
FIG. 12 is a graph showing noise reduction effect in a case where θ=60°.

Similarly to the first embodiment, also in the present embodiment, numerical analysis is performed as shown in FIGS. 10 to 12 by the analysis model shown in FIG. 9. For the width b1 of the first divided opening 50, the width b2 of the second divided opening 52, and the width b3 of the third divided opening 52, let K be the sound absorption constant, then the noise reduction amounts TL1, TL2, and TL3 of the respective divided openings 50, 52, and 54 are represented by the following mathematical expression (11): where l1 is the length of the sound insulating plate 48 forming the first and second divided openings 50 and 52, and l2 is the length of the sound insulating plate 49 forming the second and third divided openings 52 and 54. It should be noted that in the analysis model, the thickness of the wall of the exhaust duct 10, the thickness of the sound insulating plate 48 and 49, and the thickness of the sound absorbing material 42 stuck thereto are sufficiently smaller than the widths of the respective divided openings 50, 52, and 54, that is, calculation is made assuming that b=b1+b2+b3 is satisfied.

[Mathematical Expression 11]

$$TL1=K\times2(a+b1)/a/b1\times l1+K\times2(a+b1+b2)/a/(b1+b2)\times(l2-l1)+K\times2(a+b)/a/b\times(l-l2)$$

$$TL2=K\times2(a+b2)/a/b2\times l1+K\times2(a+b1+b2)/a/(b1+b2)\times(l2-l1)+K\times2(a+b)/a/b\times(l-l2)$$

$$TL3=K\times2(a+b3)/a/b3\times l2+K\times2(a+b)/a/b\times(l-l2) \quad (11)$$

Maximizing TL1, TL2, and TL3 in mathematical expression (11) allows the noise reduction effect to be maximized, but each variable (b1, b2, b3, l1, l2) in mathematical expression (11) is not independent of each other. Since the size of the exhaust duct 10 is specified, b1+b2+b3 takes a constant value b. As described above, the lengths l1 and l2 of the sound insulating plates 48 and 49 are determined so that the space between the sound insulating plates 48 and 49 and the gas cooler 12 is a predetermined space d (see FIG. 8).

FIG. 10 shows the result of analyzing the noise reduction amount TL of the analysis model in FIG. 3 at θ=30°. The horizontal axis shows the ratio of the width b1 of the first divided opening 50 to the width b of the exhaust duct 10. The vertical axis shows the ratio of the width b2 of the second divided opening 52 to the width b of the exhaust duct 10. In FIG. 10, a graph of the noise reduction amount TL (average value of TL1, TL2, and TL3) with respect to these ratios is shown. In the graphs in FIGS. 10 to 12, a graph connecting equal noise reduction amount TL is plotted every 0.2 dB, and the closer to the center of the equal noise reduction amount line diagram, the larger the noise reduction volume is. Therefore, in the case where silent performance is evaluated from graphs, when the noise reduction amount TL is the largest, that is, at the center of the equal noise reduction amount line diagram, it can be evaluated that the best silent performance is exhibited. Accordingly, in the graph in FIG. 10, the best silent performance is exhibited when b1/b=0.59 and b2/b=0.21.

FIGS. 11 and 12 show the analysis results of the noise reduction amount TL by using the same analysis model when θ=45° and 60°. As shown in FIG. 11, in the case where θ=45°, when b1/b=0.53 and b2/b=0.23, the best silent performance is exhibited. As shown in FIG. 12, in the case where θ=60°, when b1/b=0.47 and b2/b=0.26, the best silent performance is exhibited.

Similarly to the first embodiment, when the inclination angle θ of the gas cooler 12 is set in the range of 30°≤θ≤65°, the inside of the range of mathematical expression (9) (the inside of the range indicated by the hatched portion in FIGS. 10 to 12) includes a region in which the best silent performance is exhibited in each graph in FIGS. 10 to 12. Therefore, setting the widths b1, b2, and b3 of the first to third divided openings 50, 52, and 54 so as to be approximately within the range of the above mathematical expression (9) (within the range indicated by the hatched portion in FIGS. 10 to 12) allows good silent performance to be exhibited.

FIGS. 13 to 16 show modifications that can be applied in common to the packaged compressor 2 of the first embodiment or the second embodiment.

(First Modification)

Figure 13:
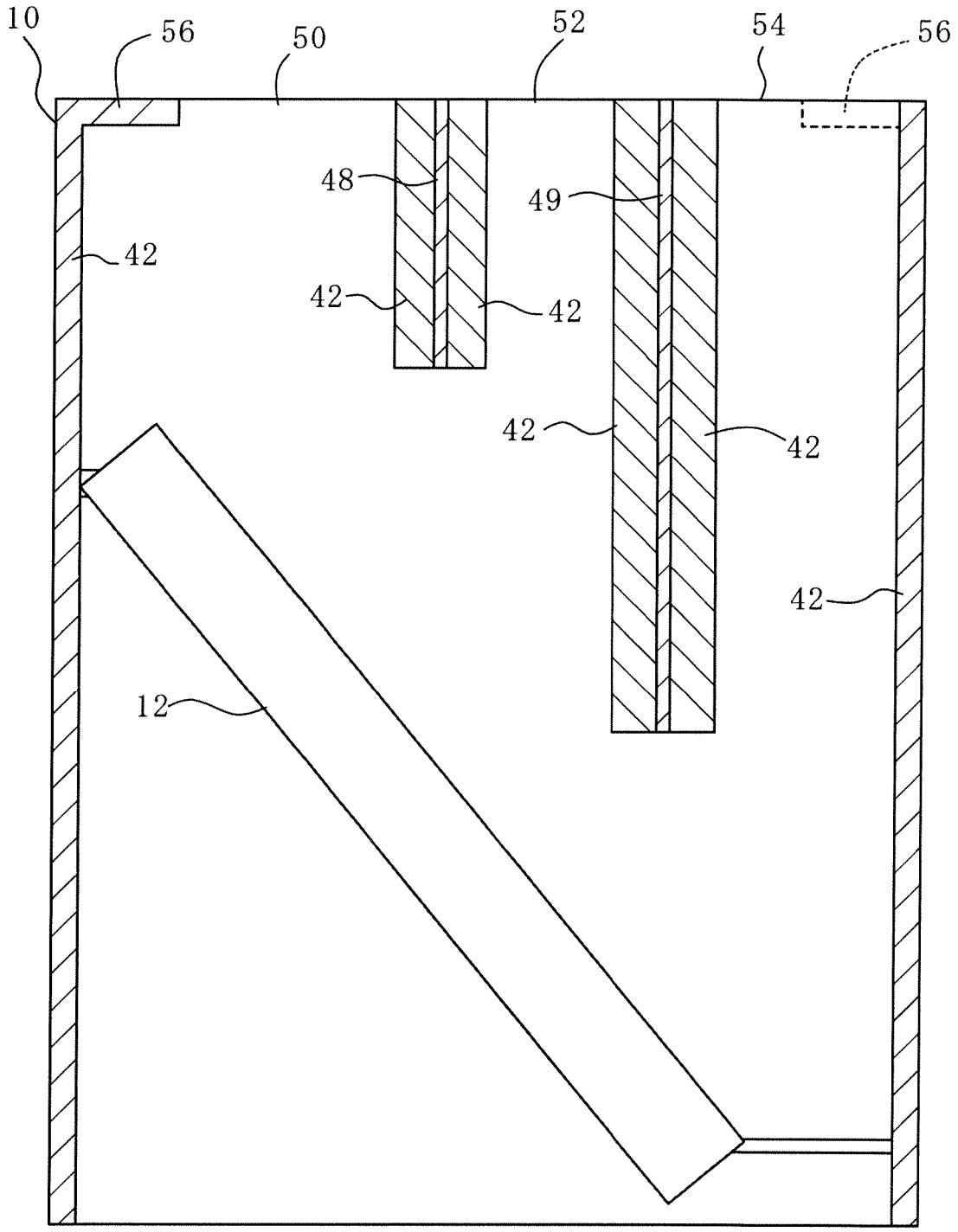
FIG. 13 is a side view of a duct portion showing a first modification of the packaged compressor.

As shown in FIG. 13, in the present modification, the first divided opening 50 is provided with a blocking portion 56 for partially blocking a region on a side opposite to the sound insulating plate 48. The blocking portion 56 of the present embodiment is made of a steel plate and is formed by bending a part of the exhaust duct 10.

Since the size of the first divided opening 50 is the largest among those of the respective divided openings 50, 52, and 54, the noise reduction effect in the first divided opening 50 tends to be the minimum as compared with the noise reduction effect in the other divided openings 52 and 54. Furthermore, since the first divided opening 50 is provided on the side on which the distance between the gas cooler 12 and the exhaust port 16 is the shortest, the maximum value of the length of the sound insulating plate 48 that can be installed is also shorter than that of the other sound insulating plate 49, and the noise reduction effect tends to be minimized as compared with the other divided openings 52 and 54. Therefore, as in the above configuration, blocking a part of the first divided opening 50 and preventing noise from leaking out allow the noise reduction effect to be improved. In particular, in the present modification, in the first divided opening 50, since the noise reduction effect is large in the vicinity of the sound insulating plate 48, it is effective to partially block the region on the side opposite to the sound insulating plate 48. Furthermore, when the size of the exhaust port 16 is sufficiently secured in consideration of the cooling capacity of the packaged compressor 2, no adverse effect due to the provision of the blocking portion 56 occurs, so that the configuration of the present modification is useful.

However, the position of the blocking portion 56 is not limited to the first divided opening 50. For example, as indicated by a broken line in FIG. 13, the position of the blocking portion 56 may be in a region on the side opposite to the sound insulating plate 49 in the third divided opening 52.

(Second Modification)

Figure 14:
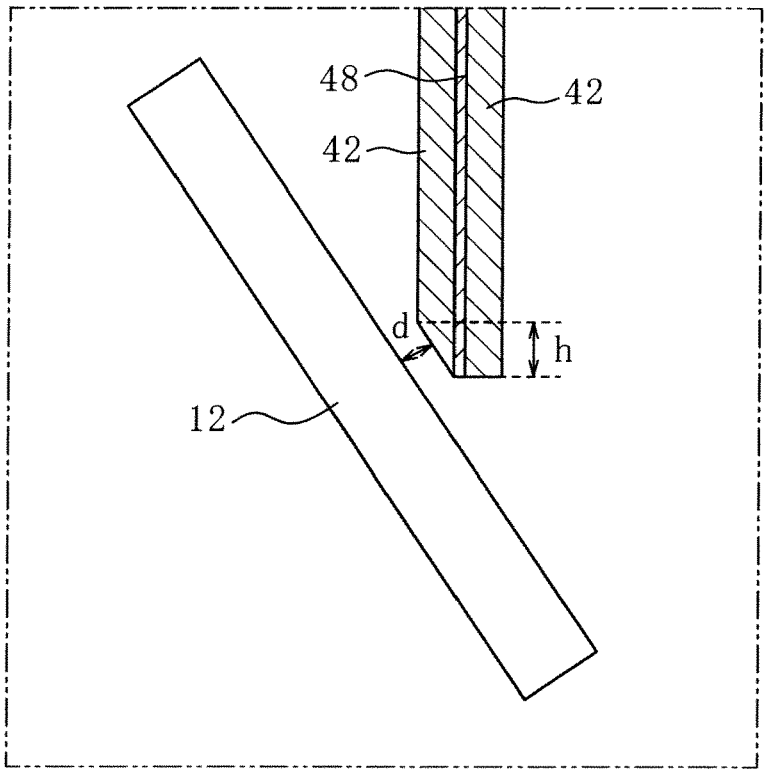
FIG. 14 is a side view of a duct portion showing a second modification of the packaged compressor.

As shown in FIG. 14, in the present modification, a tip portion 58 of the sound absorbing material 42 of the sound insulating plate 48, which faces the gas cooler 12, is chamfered. That is, a part of the sound absorbing material 42 of the tip portion 58 on the gas cooler 12 side of the sound insulating plate 48 is cut off.

The sound absorbing material 42 can be separated from the gas cooler 12 by the amount by which the sound absorbing material 42 of the sound insulating plate 48 is chamfered, and the sound insulating plate 48 can be lengthened by that amount. In the present modification, the sound insulating plate 48 is formed longer than those of the first and second embodiments by the distance h while the distance d between the gas cooler 12 and the sound insulating plate 48 (sound absorbing material 42) is maintained, where the distances h and d correspond to amounts by which a part of the sound absorbing material 42 is cut off.

(Third Modification)

Figure 15:
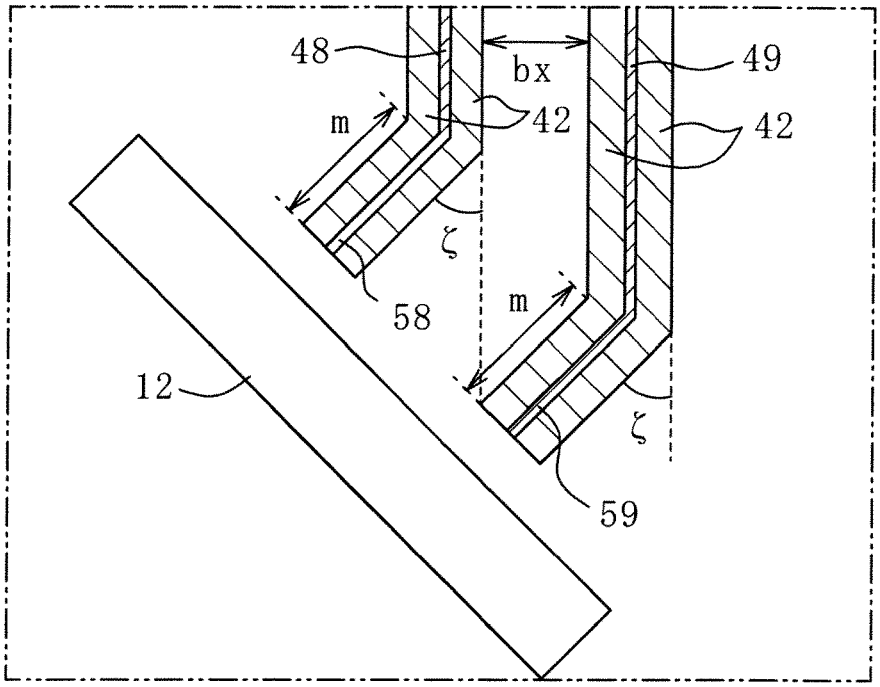
FIG. 15 is a side view of a duct portion showing a third modification of the packaged compressor.

As shown in FIG. 15, in the present modification, the tip portions 58 and 59 of the sound insulating plates 48 and 49 are bent toward the gas cooler 12. Specifically, the tip portions 58 and 59 of the sound insulating plates 48 and 49 are bent into a shape defined by the following mathematical expression (12):

[Mathematical Expression 12]

$$m \times \sin \zeta > bx \tag{12}$$

m: length of tip portions 58 and 59 of sound insulating plates 48 and 49

ζ: bending angle of tip portions 58 and 59 of sound insulating plates 48 and 49 bx: width of divided opening partitioned by sound insulating plates 48 and 49

According to the configuration of the present modification, since the tip portions 58 of the sound insulating plates 48 and 49 are bent, it is difficult for the sound waves traveling between the sound insulating plates 48 and 49 to travel straight, that is, noise hardly leaks directly to the outside. Therefore, the noise reduction effect can be improved and the silent performance can be improved. Furthermore, when the inside of the exhaust duct 10 is viewed from the exhaust port 16, since the gas cooler 12 is positioned behind the bent tip portions 58 and 59 of the sound insulating plates 48 and 49, that is, the gas cooler 12 cannot be directly viewed, it is possible to prevent noise from the gas cooler 12 from directly leaking out to the outside and to improve the noise reduction effect.

(Fourth Modification)

Figure 16:
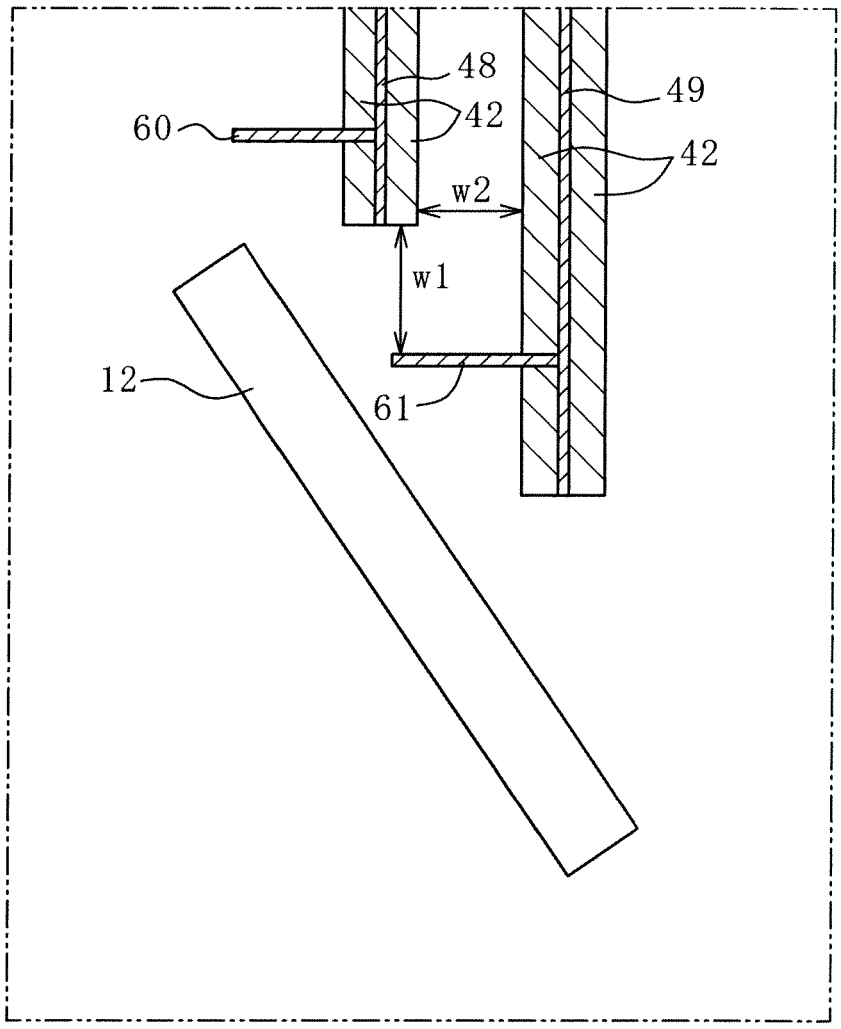
FIG. 16 is a side view of a duct portion showing a fourth modification of the packaged compressor.

As shown in FIG. 16, in the present modification, the sound insulating plates 48 and 49 are provided with protruding portions 60 and 61 on the surfaces facing the gas cooler 12. The protruding portions 60 and 61 are formed by welding steel plates at right angles to the sound insulating plates 48 and 49. The mode of the protruding portions 60 and 61 is not particularly limited, and the position, size, and installation angle thereof may be freely changed. Preferably, from the viewpoint of pressure loss and the like, the protruding portion 61 is arranged so that the distance w1 between the protruding portion 61 and the sound insulating plate 48 is larger than the distance w2 between the two sound insulating plates 48 and 49 including the sound absorbing material 42. In addition, the protruding portions 60 and 61 may also be covered with a sound absorbing material.

According to the configuration of the present modification, as in the third modification, it is possible to prevent noise from directly leaking to the outside and to improve the noise reduction effect. In addition, since only the protruding portions 60 and 61 are provided, the flow passage area between the sound insulating plates 48 and 49 is not reduced.

Figure 17:
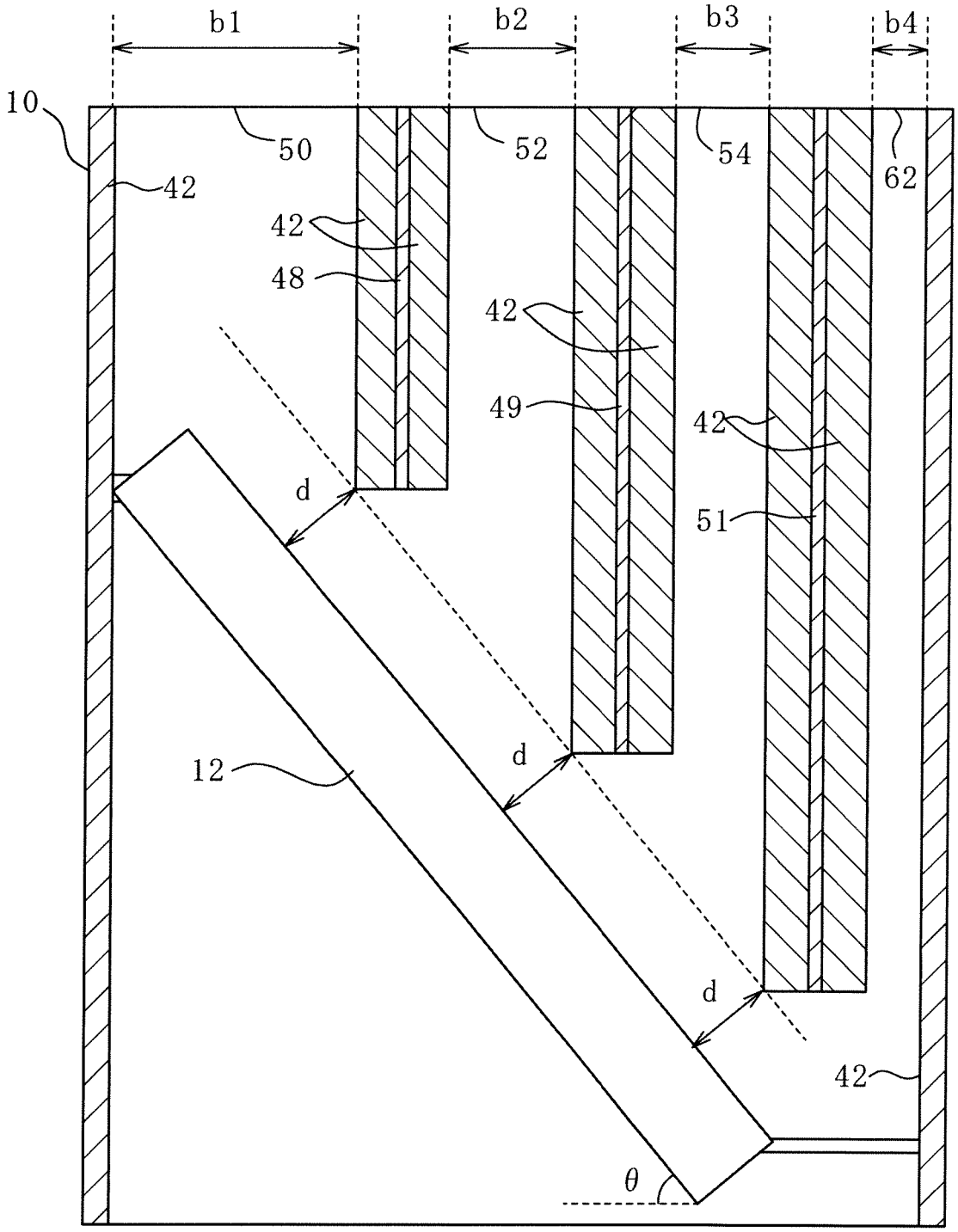
FIG. 17 is an enlarged view of a duct portion in a case where three sound insulating plates are arranged.

As described above, although the specific embodiments of the present invention and its modifications are described, the present invention is not limited to the above-described embodiments, and various modifications can be made within the scope of the present invention. For example, an appropriate combination of contents of the individual embodiments may be one embodiment of the present invention. Furthermore, the number of sound insulating plates is not particularly limited, and as shown in FIG. 17, three sound insulating plates 48, 49, and 51 may be arranged. Also in this case, the relationship between the widths b1, b2, b3, and b4 of the respective divided openings 50, 52, 54, and 62, the space d between the sound insulating plates 48, 49, and 51 and the gas cooler 12, and the like are similar to those of the first and second embodiments. Furthermore, although not shown, four or more sound insulating plates may be arranged.

The invention claimed is:

1. A packaged compressor housing comprising:

a duct having an opening;

a heat exchanger arranged to be inclined with respect to the opening of the duct; and at least one sound insulating plate arranged in a direction perpendicular to the opening of the duct and configured to partition the opening, wherein the opening is partitioned by the sound insulating plate into a plurality of divided openings including a first divided opening, and wherein, the first divided opening is set as one of the plurality of divided openings that is located closest to the heat exchanger; and the area of the first divided opening is larger than areas of the others of the plurality of divided openings.

2. The packaged compressor housing according to claim 1, wherein an inner surface of the duct is covered with a sound absorbing material.

3. The packaged compressor housing according to claim 1, wherein at least one sound insulating plate includes a first sound insulating plate and a second sound insulating plate, and wherein the first sound insulating plate is arranged closer to the first divided opening than the second insulating plate, and a length of the first sound insulating plate is shorter than a length of the second sound insulating plate.

4. The packaged compressor housing according to claim 3, wherein the first and second sound insulating plates are disposed at a predetermined equal space from the heat exchanger.

5. The packaged compressor housing according to claim 1, wherein the first divided opening is provided with a blocking portion for partially blocking an area of the first divided opening on a side opposite to the sound insulating plate.

6. The packaged compressor housing according to claim 1, wherein two of the sound insulating plates are arranged, wherein the plurality of divided openings include the first divided opening, a second divided opening, and a third divided opening positioned in the order from a side of the first divided opening, and wherein the first divided opening has a width determined by a following mathematical expression:

$$b/3<b1<2b/3 \quad \text{[Mathematical Expression 1]}$$

b=b1+b2+b3 b: width of opening b1: width of first divided opening b2: width of second divided opening b3: width of third divided opening.

7. The packaged compressor housing according to claim 6, wherein each of the second divided opening and the third divided opening has a width determined by a following mathematical expression:

$$\text{“}b2<b/3, b3<b/3\text{”} \quad \text{[Mathematical Expression 2]}$$

b=b1+b2+b3 b: width of opening b1: width of first divided opening b2: width of second divided opening b3: width of third divided opening.

8. The packaged compressor housing according to claim 1, wherein one of the sound insulating plates is arranged, and wherein the first divided opening and the second divided opening are arranged in the order from a side of the first divided opening, and a width of the first divided opening is determined by a following mathematical expression:

$$0.6 \leq b1/b \leq 0.8 \quad \text{[Mathematical Expression 3]}$$

b=b1+b2 b1: width of first divided opening b2: width of second divided opening.

9. The packaged compressor housing according to claim 8, wherein the first divided opening has a width determined by a following mathematical expression:

$$-0.0013\theta+0.67 \leq b1/b \leq -0\ 0041\theta+0.94 \quad \text{[Mathematical Expression 4]}$$

b=b1+b2 b: width of opening b1: width of first divided opening b2: width of second divided opening θ: inclination angle with respect to opening of heat exchanger.

10. The packaged compressor housing according to claim 1, wherein a surface of the sound insulating plate facing the heat exchanger is covered with a sound absorbing material, and wherein a tip portion of the sound absorbing material of the sound insulating plate facing the heat exchanger is chamfered.

11. The packaged compressor housing according to claim 1, wherein a tip portion of the sound insulating plate is bent toward the heat exchanger.

12. The packaged compressor housing according to claim 11, wherein a tip portion of the sound insulating plate has a shape defined by a following mathematical expression:

$$m \times \sin \zeta > bx \quad \text{[Mathematical Expression 5]}$$

m: length of tip portion of sound insulating plate

ζ: bending angle of tip portion of sound insulating plate bx: width of divided opening partitioned by sound insulating plate.

13. The packaged compressor housing according to claim 1, wherein the sound insulating plate includes a protruding portion on a surface facing the heat exchanger.

14. The packaged compressor housing according to claim 1, wherein the duct is an exhaust duct.

15. The packaged compressor housing according to claim 2, wherein at least one sound insulating plate includes a first sound insulating plate and a second sound insulating plate, and wherein the first sound insulating plate is arranged closer to the first divided opening than the second insulating plate, and a length of the first sound insulating plate is shorter than a length of the second sound insulating plate.

16. The packaged compressor housing according to claim 2, wherein the first divided opening is provided with a blocking portion for partially blocking an area of the divided opening on a side opposite to the sound insulating plate.

17. The packaged compressor housing according to claim 2, wherein two of the sound insulating plates are arranged, wherein the plurality of divided openings include the first divided opening, a second divided opening, and a third divided opening positioned in the order from a side of the first divided opening, and wherein the first divided opening has a width determined by a following mathematical expression:

$$b/3 < b1 < 2b/3 \quad \text{[Mathematical Expression 1]}$$

b=b1+b2+b3 b: width of opening b1: width of first divided opening b2: width of second divided opening b3: width of third divided opening.

18. The packaged compressor housing according to claim 17, wherein each of the second divided opening and the third divided opening has a width determined by a following mathematical expression:

$$b2 \leq b/3, b3 \leq b/3 \quad \text{[Mathematical Expression 2]}$$

b=b1+b2+b3 b: width of opening b1: width of first divided opening b2: width of second divided opening b3: width of third divided opening.

19. The packaged compressor housing according to claim 2, wherein one of the sound insulating plates is arranged, and wherein the first divided opening and the second divided opening are arranged in order from a side of the first divided opening, and a width of the first divided opening is determined by a following mathematical expression:

$$0.6 \leq b1/b \leq 0.8 \quad \text{[Mathematical Expression 3]}$$

b=b1+b2 b1: width of first divided opening b2: width of second divided opening.

20. The packaged compressor housing according to claim 19, wherein the first divided opening has a width determined by a following mathematical expression:

$$-0.0013\theta \pm 0.67 \leq b1/b \leq -0.0041\theta + 0.94 \quad \text{[Mathematical Expression 4]}$$

b=b1+b2 b: width of opening b1: width of first divided opening b2: width of second divided opening θ: inclination angle with respect to opening of heat exchanger.

* * * * *